US008476843B2

(12) United States Patent
Yu et al.

(10) Patent No.: US 8,476,843 B2
(45) Date of Patent: Jul. 2, 2013

(54) DRIVING CIRCUIT FOR SINGLE-STRING LED LAMP

(75) Inventors: Zuo-Shang Yu, Fuqing (CN); Tsung-Yen Lee, Fuqing (CN)

(73) Assignee: TPV Electronics (Fujian) Co., Ltd., Fuqing (CN)

( * ) Notice: Subject to any disclaimer, the term of this patent is extended or adjusted under 35 U.S.C. 154(b) by 300 days.

(21) Appl. No.: 13/007,911

(22) Filed: Jan. 17, 2011

(65) Prior Publication Data

US 2012/0181950 A1 Jul. 19, 2012

(51) Int. Cl.
*H05B 37/02* (2006.01)

(52) U.S. Cl.
USPC ..... 315/294; 315/185 R; 315/186; 315/291; 315/307; 315/308

(58) Field of Classification Search
USPC ..... 315/185 R, 186, 192, 224–226, 291, 315/307, 308
See application file for complete search history.

(56) References Cited

U.S. PATENT DOCUMENTS

| | | | | |
|---|---|---|---|---|
| 6,285,139 | B1 * | 9/2001 | Ghanem | 315/291 |
| 2007/0080911 | A1 * | 4/2007 | Liu et al. | 345/82 |
| 2008/0144236 | A1 * | 6/2008 | Chiang et al. | 361/18 |
| 2008/0224625 | A1 * | 9/2008 | Greenfeld | 315/201 |
| 2009/0237007 | A1 * | 9/2009 | Leng | 315/297 |
| 2009/0273290 | A1 * | 11/2009 | Ziegenfuss | 315/193 |
| 2011/0109231 | A1 * | 5/2011 | Shiu et al. | 315/122 |

* cited by examiner

*Primary Examiner* — Douglas W Owens
*Assistant Examiner* — Thai Pham
(74) *Attorney, Agent, or Firm* — Alan Kamrath; Kamrath IP Lawfirm, P.A.

(57) ABSTRACT

A driving circuit for a single-string light-emitting diode (LED) lamp includes a push-pull converter. The push-pull converter converts an input low DC voltage (such as 12-19V) to a high DC voltage (such as above 200V) to supply power to the single-string LED lamp. The driving circuit controls a lamp current flowing through the single-string LED lamp by constant current and adjusts brightness of the single-string LED lamp by pulse-width modulation (PWM) dimming. In addition, the single-string LED lamp provides the standardization design for connectors of the driving circuit used to connect to the single-string LED lamp so that the driving circuit has a better common-use characteristic. Moreover, the driving circuit does not need a current balance circuit and only needs a cheaper and general-purpose integrated circuit to control the push-pull converter to reduce design cost of the driving circuit.

9 Claims, 8 Drawing Sheets

DRIVING CIRCUIT FOR SINGLE-STRING LED LAMP

BACKGROUND OF THE INVENTION

1. Field of the Invention

The present invention relates to a driving circuit for a light-emitting diode (LED) lamp. More particularly, the present invention relates to a driving circuit for a single-string LED lamp including a plurality LEDs all coupled in series.

2. Description of the Related Art

Liquid crystal displays (LCDs) such as LCD monitors, LCD television and all-in-one computers already use LED lamps as backlight sources. The LED lamp includes a plurality of LEDs coupled in series and/or parallel, such as eight parallel strings of ten LEDs coupled in series. A driving circuit for the LED lamp converts an input low DC voltage (such as 12-19V) to a high DC voltage (such as 30V-60V) to provide a supply voltage to drive the LED lamp, in which the supply voltage value is determined by the number of the LEDs of each string.

Presently, the LED lamp usually uses multiple parallel strings such as four, six, eight parallel strings and so on. To balance current flowing through each string, the driving circuit has to use a specific-purpose integrated circuit (IC) having current balance function or a complex current balance circuit, increasing the design cost of the driving circuit. Moreover, LED lamps fabricated by different manufacturers or even by the same manufacturer have different input/output terminal designs and include different numbers of parallel strings, so that it is impossible to provide the standardization design for connectors of the driving circuit used to connect to the LED lamp. Thus, the driving circuit for one LED lamp cannot be used for another LED lamp, wasting human resources on the designs of the driving circuits for different LED lamps.

SUMMARY OF THE INVENTION

Accordingly, a driving circuit for a single-string LED lamp provides the standardization design for connectors of the driving circuit used to connect to the LED lamp without using a specific-purpose IC having current balance function or a complex current balance.

According to an aspect of the present invention, a driving circuit for a single-string LED lamp having an input terminal and an output terminal includes a dimming control circuit, a current feedback circuit, a pulse-width modulation (PWM) control circuit and a push-pull converter. The dimming control circuit and the current feedback circuit are coupled in series between the output terminal and a ground terminal, the PWM control circuit is coupled to a feedback terminal and coupled to the dimming control circuit and the current feedback circuit through the feedback terminal, and the push-pull converter is coupled to the input terminal and the PWM control circuit.

The dimming control circuit receives a dimming signal of a PWM waveform. The dimming signal includes a plurality of consecutive cycles, and each cycle includes an on period and an off period. During the on period, the dimming control circuit controls the output terminal and the ground terminal to be closed; the current feedback circuit detects a lamp current flowing through the single-string LED lamp and outputs, according to the lamp current, a first feedback voltage to a feedback terminal; the PWM control circuit outputs two PWM signals which are 180 degrees out of phase with each other when receiving the first feedback voltage; and the push-pull converter converts, according to the PWM signals, a first direct-current (DC) voltage to a second DC voltage to output to the input terminal when receiving the PWM signals. During the off period, the dimming control circuit controls the output terminal and the ground terminal to be open and outputs a second feedback voltage to the feedback terminal; the current feedback circuit does not detect the lamp current to stop outputting the first feedback voltage; the PWM control circuit stops outputting the PWM signals when receiving the second feedback voltage; and the push-pull converter stops converting and outputting the second DC voltage when not receiving the PWM signals.

The invention provides the standardization design for connectors of the driving circuit used to connect to the single-string LED lamp, so that the driving circuit has a better common-use characteristic.

BRIEF DESCRIPTION OF THE DRAWINGS

The foregoing and other features of the disclosure will be apparent and easily understood from a further reading of the specification and claims and by reference to the accompanying drawings in which:

DESCRIPTION OF THE PREFERRED EMBODIMENTS

Figure 1:
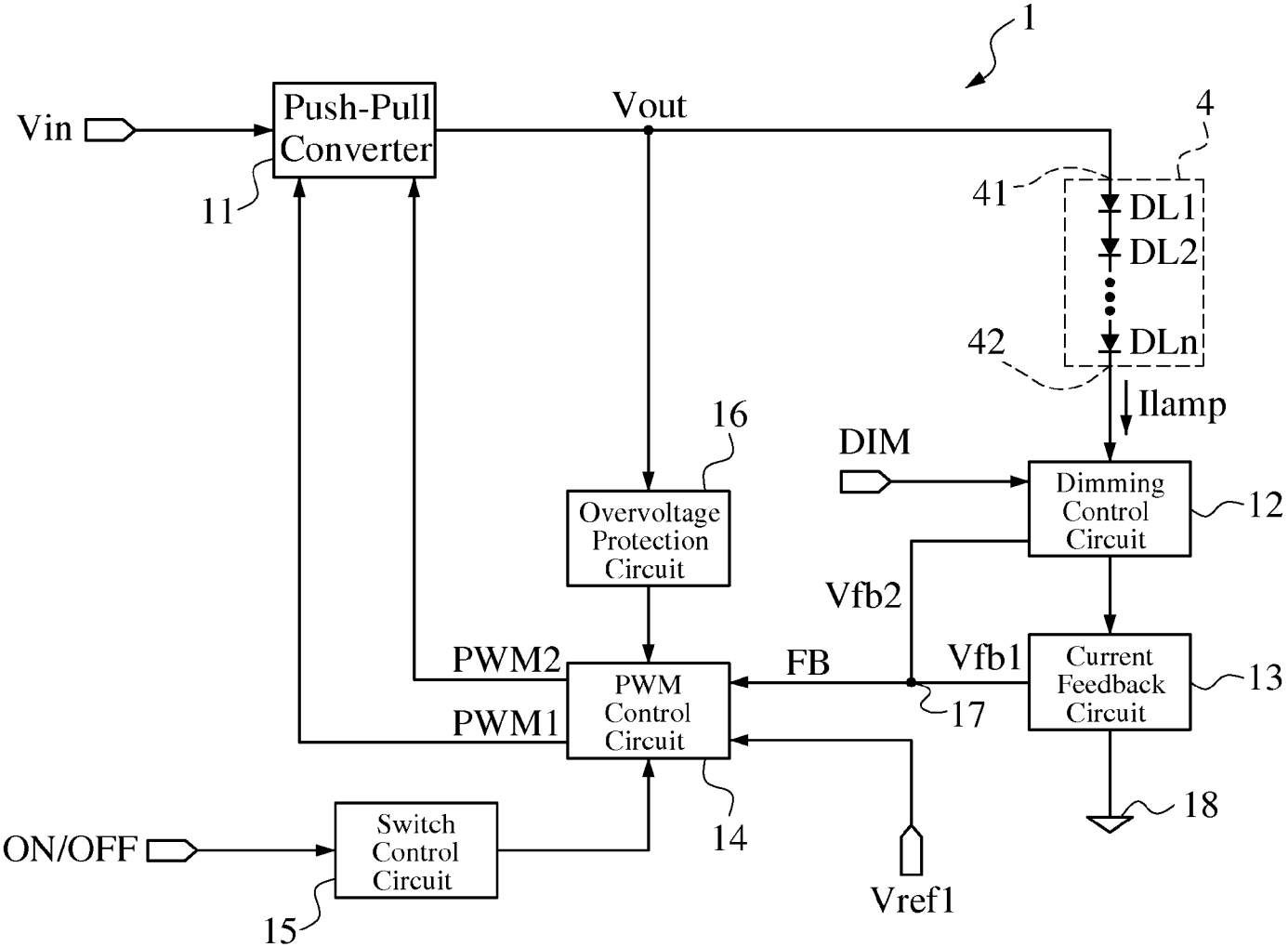
FIG. 1 is a schematic block diagram illustrating an embodiment of a driving circuit to for a single-string LED lamp according to the present invention.

FIG. 1 is a schematic block diagram illustrating an embodiment of a driving circuit for a single-string LED lamp according to the present invention. Referring to FIG. 1, a single-string LED lamp 4 includes a plurality of LEDs DL1-DLn all coupled in series to have an input terminal 41 and an output terminal 42. An anode terminal of the LED DL1 is coupled to the input terminal 41, a cathode terminal of the LED DLi is coupled to an anode terminal of the LED DL(i+1), and a cathode terminal of the LED DLn is coupled to the output terminal 42, where i is any integer from 1 to (n−1). A driving circuit 1 for the single-string LED lamp 4 includes a push-pull converter 11, a dimming control circuit 12, a current feedback circuit 13, a PWM control circuit 14, a switch control circuit 15 and an overvoltage protection circuit 16. The dimming control circuit 12 and the current feedback circuit 13 are coupled in series between the output terminal 42 and a ground terminal 18. The PWM control circuit 14 is coupled to a feedback terminal 17 and coupled to the dimming control circuit 12 and the current feedback circuit 13 through the feedback terminal 17. The push-pull converter 11 is coupled to the input terminal 41 and the PWM control circuit 14. The switch control circuit 15 is coupled to the PWM control circuit 14. The overvoltage protection circuit 16 is coupled to the input terminal 41 and the PWM control circuit 14.

The dimming control circuit 12 receives a dimming signal DIM of a PWM waveform. The dimming signal DIM includes a plurality of consecutive cycles, and each cycle T includes an on period Ton and an off period Toff (further described hereinafter with reference to FIG. 5). During the on period Ton, the dimming control circuit 12 controls the output terminal 42 and the ground terminal 18 to be closed, meaning that current can flow from the output terminal 42 to the ground terminal 18. The current feedback circuit 13 detects a lamp current Ilamp flowing through the single-string LED lamp 4 and outputs, according to the lamp current Ilamp, a first feedback voltage Vfb1 to a feedback terminal 17. The PWM control circuit 14 outputs two PWM signals PWM1 and PWM2, which are 180 degrees out of phase with each other when receiving the first feedback voltage Vfb1. The push-pull converter 11 converts, according to the PWM signals PWM1 and PWM2, a first DC voltage Vin to a second DC voltage Vout to output to the input terminal 41 when receiving the PWM signals PWM1 and PWM2. During the off period Toff, the dimming control circuit 12 controls the output terminal 42 and the ground terminal 18 to be open, meaning that no current can flow from the output terminal 42 to the ground terminal 18, and outputs a second feedback voltage Vfb2 to the feedback terminal 17. The current feedback circuit 13 does not detect the lamp current Ilamp to stop outputting the first feedback voltage Vfb1. The PWM control circuit 14 stops outputting the PWM signals PWM1 and PWM2 when receiving the second feedback voltage Vfb2. The push-pull converter 11 stops converting and then stops outputting the second DC voltage Vout when not receiving the PWM signals PWM1 and PWM2.

In addition, the switch control circuit 15 receives a switch signal ON/OFF and controls, according the switch signal ON/OFF, whether or not the PWM control circuit 15 works. The overvoltage protection circuit 16 controls the PWM control circuit 14 to stop outputting the PWM signals PWM1 and PWM2 when the second DC voltage Vout is greater than a threshold voltage Vref2 (further described hereinafter with reference to FIG. 6).

Figure 2:
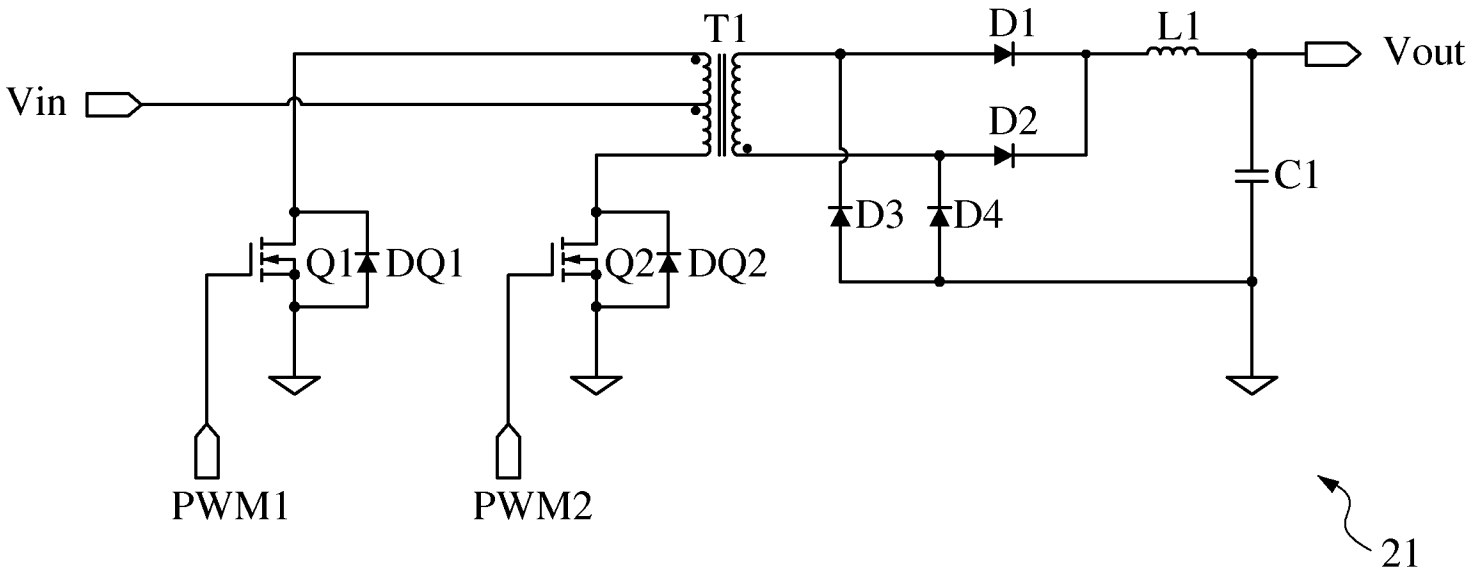
FIGS. 2 and 3 are schematic diagrams illustrating two embodiments of the push-pull converter 11 shown in FIG. 1.
Figure 3:
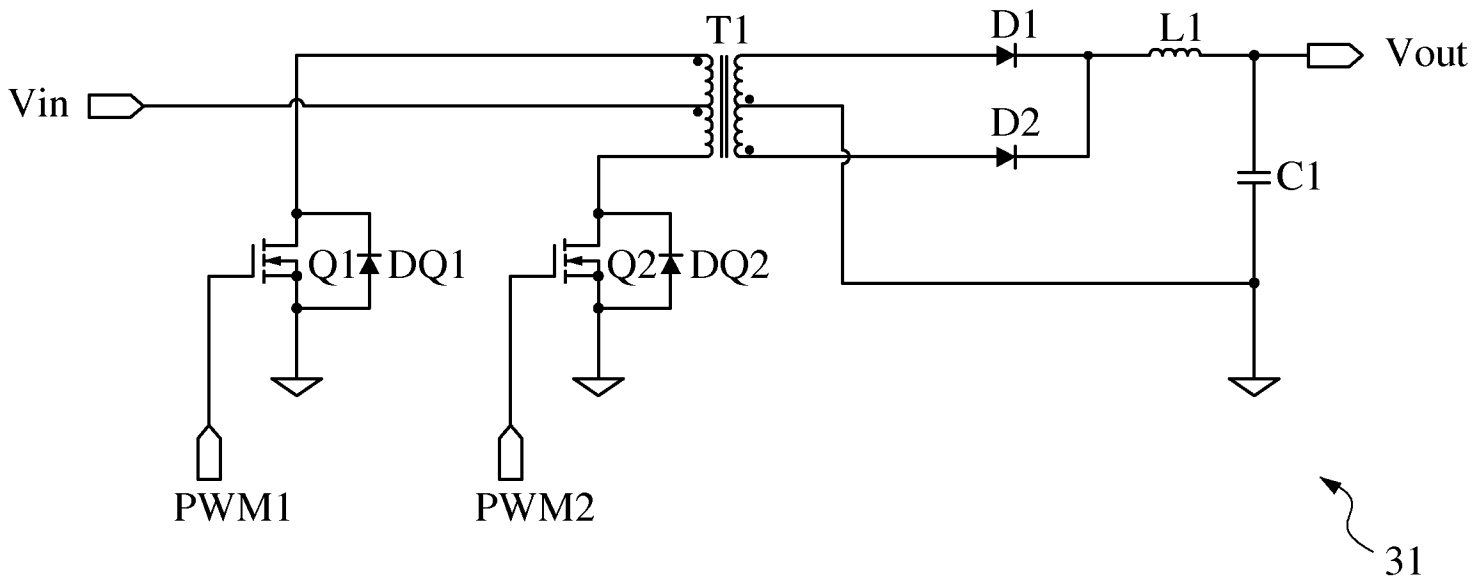

FIGS. 2 and 3 are schematic diagrams illustrating two embodiments of the push-pull converter 11 shown in FIG. 1. Referring to FIG. 2, a push-pull converter 21 includes two power switches (one includes a transistor Q1 and a diode DQ1, and the other includes a transistor Q2 and a diode DQ2), a transformer T1 having a center-tapped primary winding (including two primary half-winding) and a secondary winding, an output rectifying circuit (including diodes D1-D4) and an output filtering circuit (including an inductor L1 and a capacitor C1). The power switches alternatively couple each primary half-winding with the first DC voltage Vin. An alternating-current (AC) voltage is induced in the secondary winding, and is rectified and filtered by the output rectifying circuit and the output filtering circuit to output the second DC voltage Vout. The second DC voltage Vout can be regulated by controlling the conduction time of the power switches according to the PWM signals PWM1 and PWM2. Referring to FIG. 3, a push-pull converter 31 and the push-pull converter 21 shown in FIG. 2 differ in their output rectifying circuits. The output rectifying circuit of the push-pull converter 21 uses a full-wave bridge rectifier including the diodes D1-D4. The output rectifying circuit of the push-pull converter 31 uses two half-wave rectifiers D1 and D2 and correspondingly the transformer T1 uses a center-tapped secondary winding whose center tap is coupled to the ground terminal 18.

Figure 4:
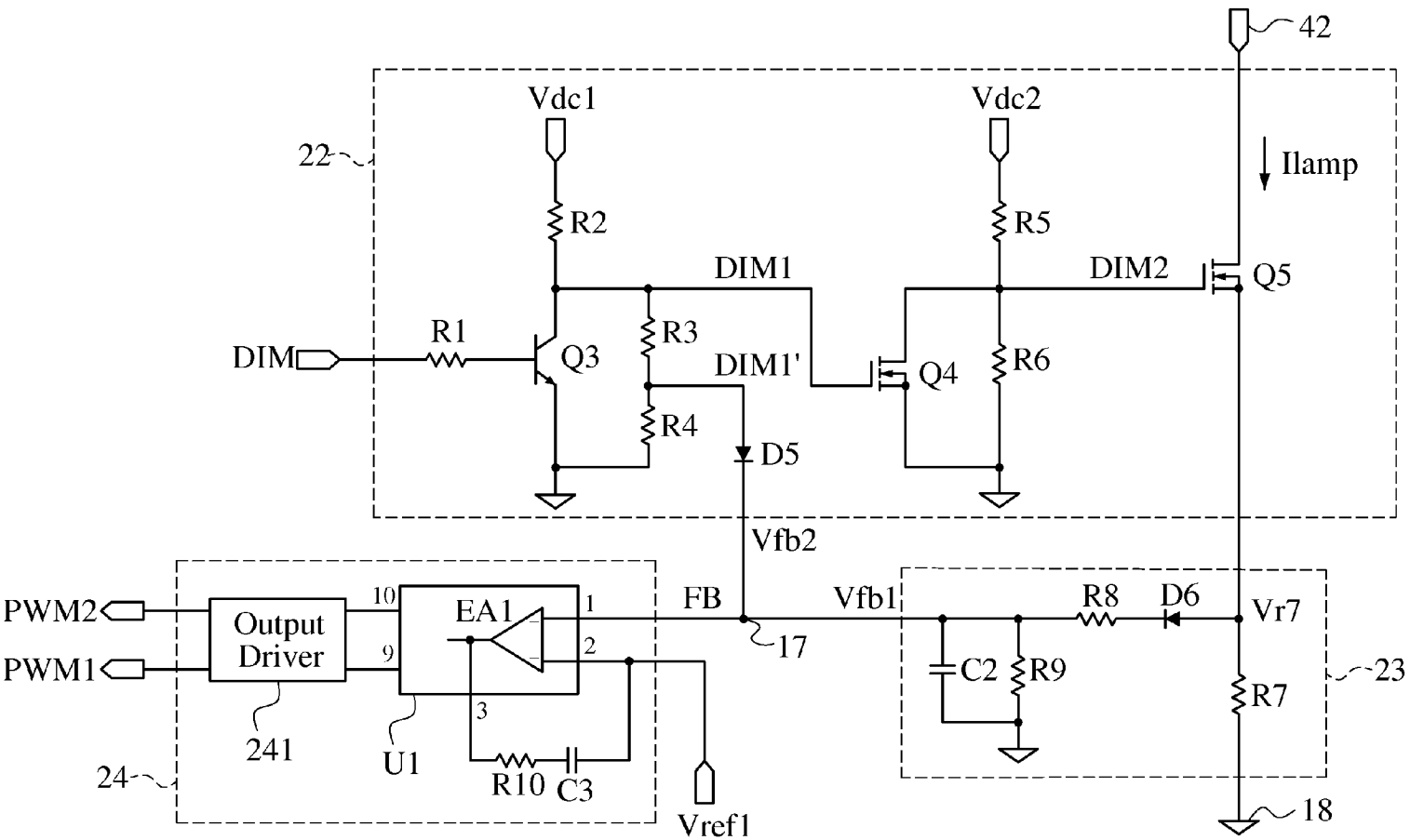
FIG. 4 is a schematic diagram illustrating an embodiment of the dimming control circuit 12, the current feedback circuit 13 and the PWM control circuit 14 shown in FIG. 1.
Figure 5:
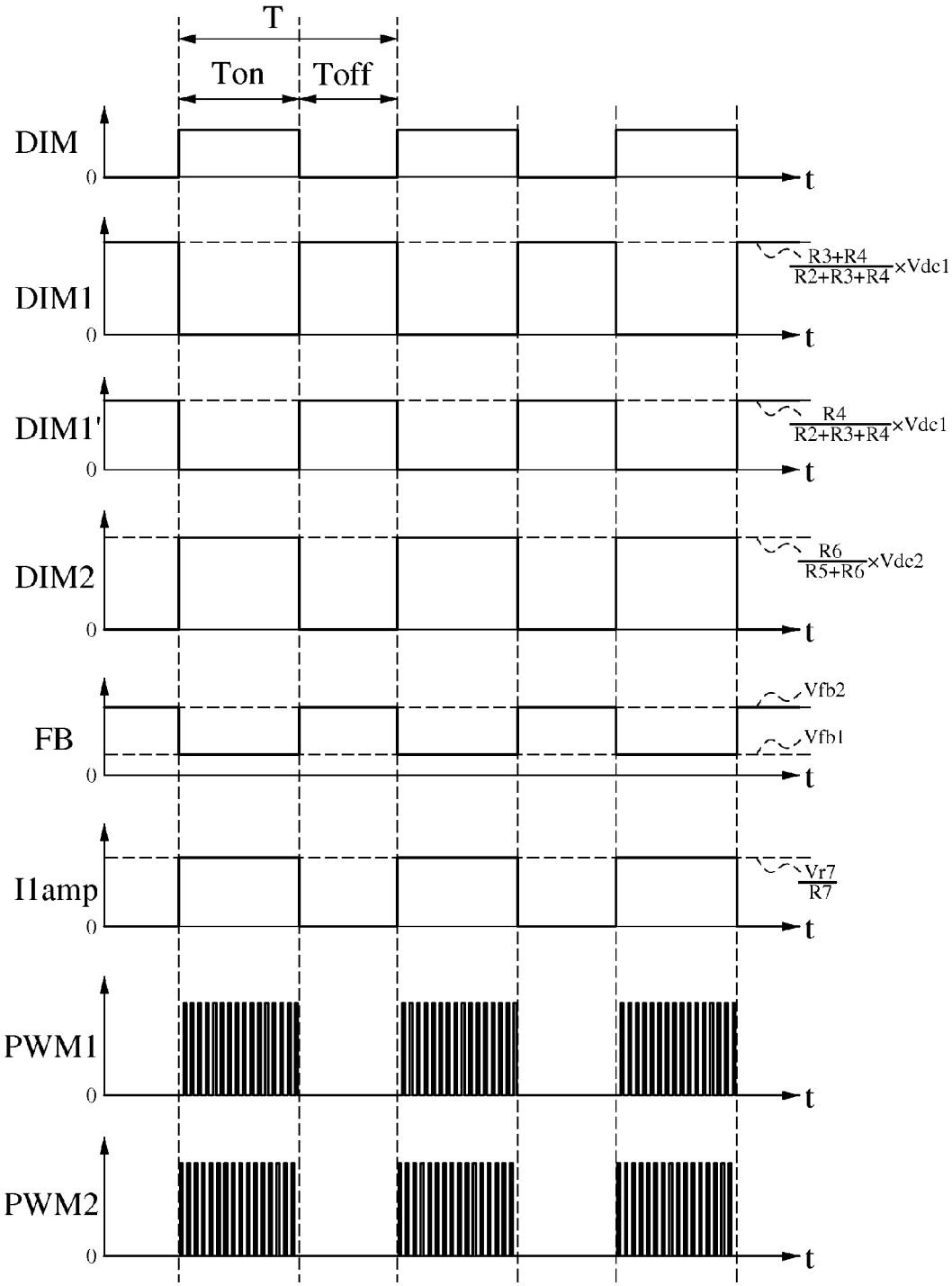
FIG. 5 is a timing diagram illustrating a PWM dimming control for the dimming control circuit 22, the current feedback circuit 23 and the PWM control circuit 24 shown in FIG. 4.

FIG. 4 is a schematic diagram illustrating an embodiment of the dimming control circuit 12, the current feedback circuit 13 and the PWM control circuit 14 shown in FIG. 1, and FIG. 5 is a timing diagram illustrating a PWM dimming control for the circuitry shown in FIG. 4. Referring to FIGS. 4 and 5, a dimming control circuit 22 includes a unidirectional component (including a diode D5), a first inverter (including a transistor Q3 and resistors R1-R4), a second inverter (including a transistor Q4 and resistors R5 and R6) and a switch (including a transistor Q5). The first inverter (including the transistor Q3 and the resistors R1-R4) receives the dimming signal DIM and outputs an antiphase dimming signal DIM1 which is 180 degrees out of phase with the dimming signal DIM. The antiphase dimming signal DIM1 is coupled to the feedback terminal 17 through the unidirectional component (including the diode D5) to stop outputting the second feedback voltage Vfb2 (related to the antiphase dimming signal DIM1) to the feedback terminal 17 during the on period Ton, and output the second feedback voltage Vfb2 to the feedback terminal 17 during the off period Toff. The second inverter (including the transistor Q4 and the resistors R5-R6) is coupled to the first inverter (including the transistor Q3 and the resistors R1-R4). The second inverter (including the transistor Q4 and the resistors R5-R6) receives the antiphase dimming signal DIM1 and outputs an in-phase dimming signal DIM2 which is 180 degrees out of phase with the antiphase dimming signal DIM1. The switch (including the transistor Q5) and a current feedback circuit 23 are coupled in series between the output terminal 42 and the ground terminal 18. The switch (including the transistor Q5) is turned on or off according to the in-phase dimming signal DIM2. During the on period Ton, the switch (including the transistor Q5) is turned on to control the output terminal 42 and the ground terminal 18 to be closed. During the off period Toff, the switch (including the transistor Q5) is turned off to control the output terminal 42 and the ground terminal 18 to be open.

During the on period Ton, the dimming signal DIM is at high level to turn on the transistor Q3 to cause the antiphase dimming signal DIM1 at low level (voltage is zero) to turn off the transistor Q4 to cause the in-phase dimming signal DIM2 at high level (voltage is R6/(R5+R6)×Vdc2) to turn on the transistor Q5 to control the output terminal 42 and the ground terminal 18 to be closed so that the lamp current Ilamp is not zero and the single-string LED lamp 4 provides light, where Vdc2 is a DC voltage. During the off period Toff, the dimming signal DIM is at a low level to turn off the transistor Q3 to cause the antiphase dimming signal DIM1 at a high level (voltage is (R3+R4)/(R2+R3+R4)×Vdc1) to turn on the transistor Q4 to cause the in-phase dimming signal DIM2 at a low level (voltage is zero) to turn off the transistor Q5 to control the output terminal 42 and the ground terminal 18 to be open so that the lamp current Ilamp is zero and the single-string LED lamp 4 does not provide light, where Vdc1 is a DC voltage. Accordingly, the single-string LED lamp 4 provides light (bright) during the on period Ton and does not provide light (dark) during the off period Toff. If the frequency of dimming signal DIM is above 150 Hz, the human eye will perceive an average brightness depending on the ratio of time periods of the bright and dark of the single-string LED lamp 4 due to the persistence of vision. Accordingly, the perceived brightness can be adjusted by adjusting the duty cycle of the dimming signal DIM to adjust the ratio of time periods of the bright and dark of the single-string LED lamp 4. The brightness adjusting method is known as PWM dimming or burst mode dimming.

Furthermore, the antiphase dimming signal DIM1 is voltage-divided by the resistors R3 and R4 to generate another antiphase dimming signal DIM1', and the antiphase dimming signal DIM1' is coupled to the feedback terminal 17 through the diode D5. During the on period Ton, the antiphase dimming signal DIM1 is a voltage of zero to cause the antiphase dimming signal DIM1' to be a voltage of zero to turn off the diode D5 to stop outputting the second feedback voltage Vfb2 to the feedback terminal 17. During the off period Toff, the antiphase dimming signal DIM1 is a voltage of (R3+R4)/(R2+R3+R4)×Vdc1 to cause the antiphase dimming signal DIM1' to be a voltage of R4/(R2+R3+R4)×Vdc1 to turn on the diode D5 to outputting output the second feedback voltage Vfb2 (voltage is R4/(R2+R3+R4)×Vdc1−Vd5) to the feedback terminal 17, where Vd5 is the forward voltage of the diode D5. The resistors R3 and R4 are used for adjusting the feedback amount of the second feedback voltage Vfb2.

The current feedback circuit 23 includes a unidirectional component (including a diode D6) and a current detector (including a resistor R7). The current detector (including the resistor R7) and the switch (including the transistor Q5) of the dimming control circuit 22 are coupled in series between the output terminal 42 and the ground terminal 18. The current detector (including the resistor R7) detects the lamp current Ilamp and outputs, according to the lamp current Ilamp, a detecting voltage Vr7. The detecting voltage Vr7 is coupled to the feedback terminal 17 through the unidirectional component (including the diode D6) to output the first feedback voltage Vfb1 (related to the detecting voltage Vr7) to the feedback terminal 17 during the on period Ton, and to stop outputting the first feedback voltage Vfb1 to the feedback terminal 17 during the off period Toff. The current feedback circuit 23 further includes resistors R8 and R9 and a capacitor C2. The resistors R8 and R9 are used for voltage-dividing to adjust the feedback amount of the first feedback voltage Vfb1, and it is necessary that the resistances of the resistors R8 and R9 is much greater than the resistance of the resistor R7 to ensure the lamp current Ilamp flowing to the current detector R7. The capacitor C2 is used for filtering high-frequency noise.

During the on period Ton, the transistor Q5 is turned on so that the lamp current Ilamp is not zero, flowing through the resistor R7 to generate the detecting voltage Vr7 corresponding to the lamp current Ilamp to turn on the diode D6. Accordingly, the detecting voltage Vr7 is voltage-divided by the resistors R8 and R9 to generate the first feedback voltage Vfb1 (voltage is (Vr7−Vd6)×R9/(R8+R9)) to output to the feedback terminal 17, where Vd6 is the forward voltage of the diode D6. During the off period Toff, the transistor Q5 is turned off so that the lamp current Ilamp is zero, causing the detecting voltage Vr7 to be zero to turn off the diode D6. Accordingly, it stops outputting the first feedback voltage Vfb1 to the feedback terminal 17. Therefore, a voltage at the feedback terminal 17 (called a feedback terminal signal FB hereinafter) is the first feedback voltage Vfb1 (voltage is (Vr7−Vd6)×R9/(R8+R9)) during the on period Ton, and is the second feedback voltage Vfb2 (voltage is R4/(R2+R3+R4)×Vdc1−Vd5) during the off period Toff. In the embodiment, the first feedback voltage Vfb1 is less than the second feedback voltage Vfb2.

A PWM control circuit 24 includes a PWM controller U1, an output driver 241 and an RC compensation circuit (including a resistor R10 and a capacitor C3). The PWM controller U1 includes an error amplifier EA1. The error amplifier EA1 has a non-inverting input terminal coupled to the feedback terminal 17, an inverting input terminal coupled to receive a reference voltage Vref1 and an output terminal. For example, the PWM controller U1 is a TL494 IC having 16 pins, in which the first to the third pins are the non-inverting input terminal, the inverting input terminal and the output terminal of the error amplifier EA1, respectively; and, the ninth and the tenth pins are used for outputting the PWM signals PWM1 and PWM2. The resistor R10 and the capacitor C3 are coupled in series between the inverting input terminal and the output terminal of the error amplifier EA1 to provide a negative feedback path so that the non-inverting input terminal and the inverting input terminal of the error amplifier EA1 has a virtual short characteristic.

During the on period Ton, the feedback terminal signal FB (voltage now is the first feedback voltage Vfb1) is forced to be equal to the reference voltage Vref1 due to the virtual short characteristic to control the PWM controller U1 to output the PWM signals PWM1 and PWM2. The lamp current Ilamp is Vr7/R7 and the first feedback voltage Vfb1 is (Vr7−Vd6)×R9/(R8+R9), so that the lamp current Ilamp can be determined by setting the reference voltage Vref1 and the resistance of the resistor R7. Moreover, the PWM signals PWM1 and PWM2 outputted by the PWM controller U1 may not have sufficient driving ability to drive the transistors Q1 and Q2 of the push-pull converter 21 or 31 shown in FIG. 2 or 3. Accordingly, the output driver 241 is introduced to enhance the driving ability of the PWM signals PWM1 and PWM2 outputted by the PWM controller U1. During the off period Toff, the feedback terminal signal FB (voltage now is the second feedback voltage Vfb2) is greater than the reference voltage Vref1 to control the PWM controller U1 to stop outputting the PWM signals PWM1 and PWM2. Therefore, the error amplifier EA1 is used for the feedback control of the lamp current Ilamp and the PWM dimming of the single-string LED lamp 4.

Figure 6:
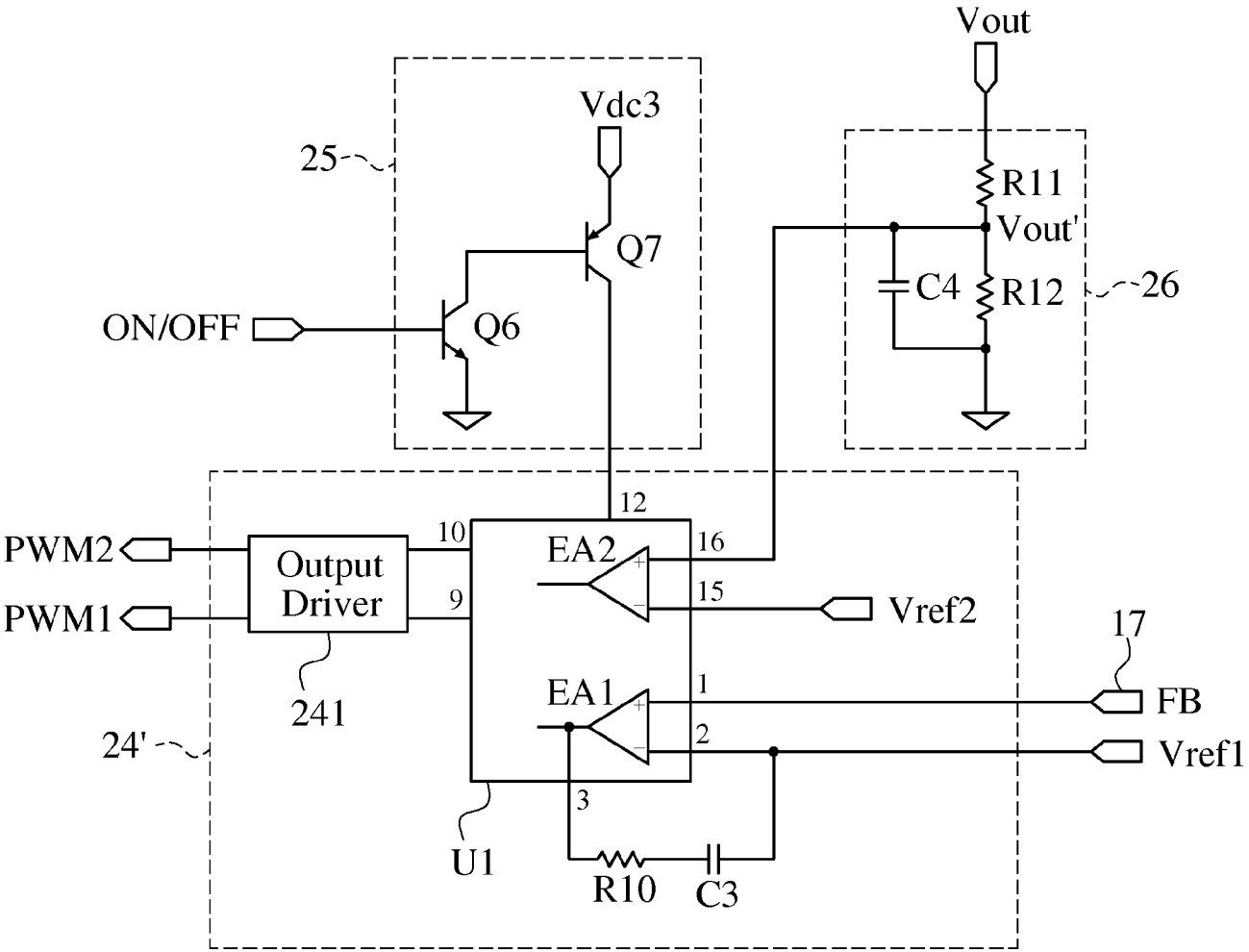
FIG. 6 is a schematic diagram illustrating another embodiment of the PWM control circuit 14 and an embodiment of the switch control circuit 15 and the overvoltage protection circuit 16 shown in FIG. 1.

FIG. 6 is a schematic diagram illustrating another embodiment of the PWM control circuit 14 and an embodiment of the switch control circuit 15 and the overvoltage protection circuit 16 shown in FIG. 1. Referring to FIG. 6, a PWM control circuit 24' includes the PWM controller U1, the output driver 241 and the RC compensation circuit (including the resistor R10 and the capacitor C3). The PWM controller U1 further includes another error amplifier EA2. The error amplifier EA2 is used for the overvoltage protection of the single-string LED lamp 4. For example, the PWM controller U1 is the TL494 IC, in which the sixteenth and the fifteenth pins are a non-inverting input terminal and an inverting input terminal of the error amplifier EA2, respectively; and in which the twelfth pin is used for receiving a DC voltage supplying power to the PWM controller U1.

A switch control circuit 25 includes transistors Q6 and Q7. When the switch signal ON/OFF is at high level representing "ON", the transistor Q6 is turned on to turn on the transistor Q7 so that a DC voltage Vdc3 can deliver and supply power to the PWM controller U1. When the switch signal ON/OFF is at low level representing "OFF", the transistor Q6 is turned off to turn off the transistor Q7 so that the DC voltage Vdc3 cannot deliver and supply power to the PWM controller U1 and so that the PWM controller U1 stops working to cause the PWM control circuit 24' to stop working. Thus, the switch control circuit 25 can be used for controlling whether or not the driving circuit 1 for the single-string LED lamp 4 works. For example, in a power-saving mode, the driving circuit 1 is controlled to stop working, and, hence, the single-string LED lamp 4 does not work.

An overvoltage protection circuit 26 includes resistors R11 and R12 and a capacitor C4. The resistors R11 and R12 are used for sampling the second DC voltage Vout to generate a sampled second DC voltage Vout'. The capacitor C4 is used for filtering high-frequency noise. The overvoltage protection circuit 26 outputs the sampled second DC voltage Vout' to the error amplifier EA2 of the PWM controller U1 to be compared with the threshold voltage Vref2. When the sampled second DC voltage Vout' is less than the threshold voltage Vref2, it represents no overvoltage occurred in the second DC voltage Vout so that the error amplifier EA2 controls the PWM control circuit 24' to normally work to output the PWM signals PWM1 and PWM2. When the sampled second DC voltage Vout' is greater than the threshold voltage Vref2, it represents that an overvoltage occurred in the second DC voltage Vout so that the error amplifier EA2 controls the PWM control circuit 24' to stop working to stop outputting the PWM signals PWM1 and PWM2. Thus, the overvoltage protection circuit 26 can be used for limiting the second DC voltage Vout input to the single-string LED lamp 4 within a safe voltage to avoid an abnormal of the single-string LED lamp 4 or the driving circuit 1 results that the second DC voltage Vout is too high to burn out the single-string LED lamp 4 or the driving circuit 1.

Figure 7:
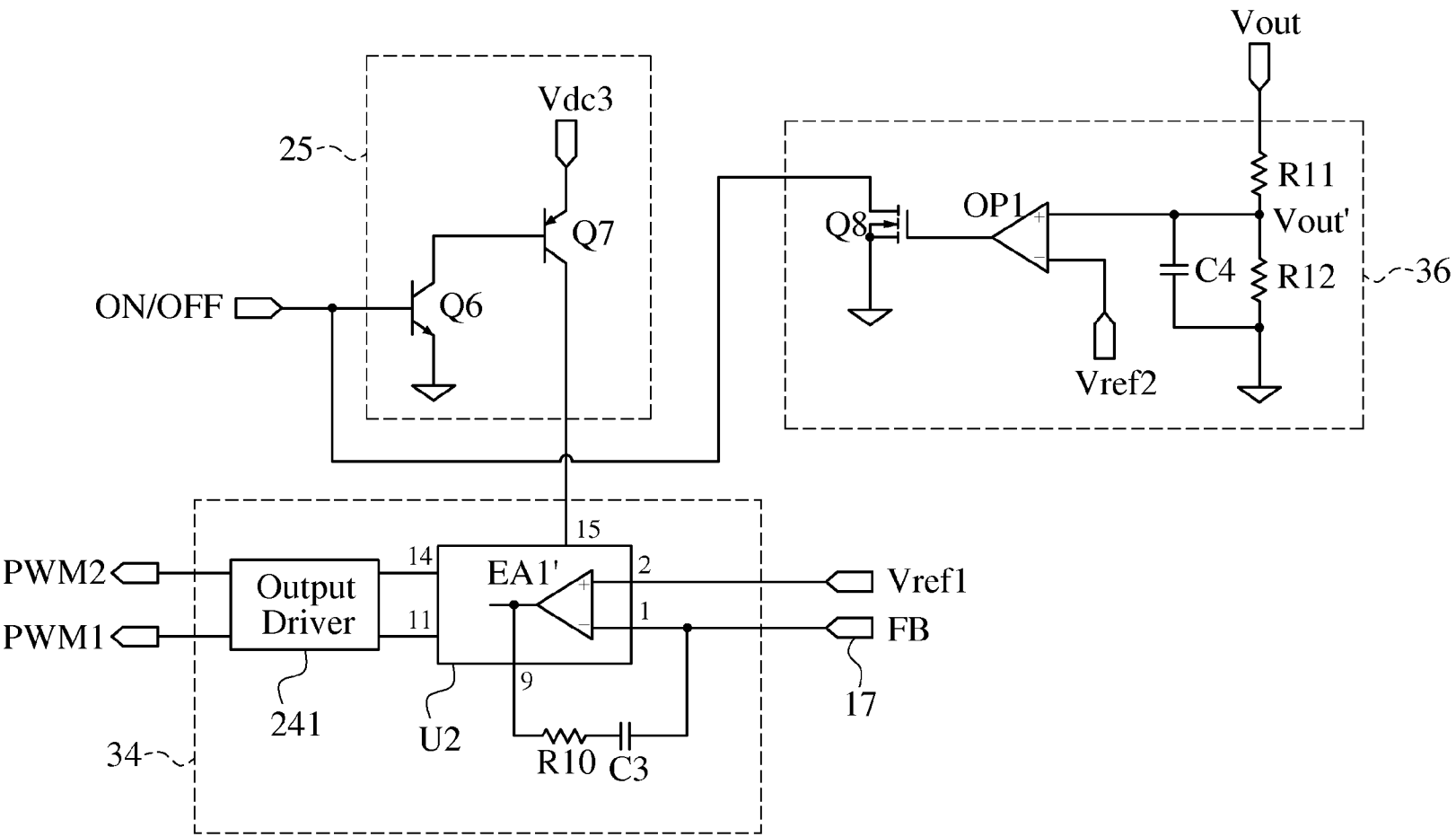
FIG. 7 is a schematic diagram illustrating yet another embodiment of the PWM control circuit 14 and another embodiment of the overvoltage protection circuit 16 shown in FIG. 1.

FIG. 7 is a schematic diagram illustrating yet another embodiment of the PWM control circuit 14 and another embodiment of the overvoltage protection circuit 16 shown in FIG. 1. Referring to FIG. 7, a PWM control circuit 34 includes a PWM controller U2, an output driver 241 and the RC compensation circuit (including the resistor R10 and the capacitor C3). The PWM controller U2 includes a single error amplifier EA1'. The single error amplifier EA1' has an inverting input terminal coupled to the feedback terminal 17, a non-inverting input terminal coupled to receive the reference voltage Vref1 and an output terminal. For example, the PWM controller U2 is a SG3525 IC having 16 pins, in which the first, the second and the ninth pins are the inverting input terminal, the non-inverting input terminal and the output terminal of the single error amplifier EA1', respectively; the eleventh and the fourteenth pins are used for outputting the PWM signals PWM1 and PWM2; and, the fifteenth pin is used for receiving a DC voltage supplying to the PWM controller U2.

An overvoltage protection circuit 36 includes the resistors R11 and R12 and the capacitor C4 shown in FIG. 6, and further includes an operational amplifier OP1 and a transistor Q8. The second DC voltage Vout is sampled by the resistors R11 and R12 to generate the sampled second DC voltage Vout' to output to the operational amplifier OP1 to be compared with the threshold voltage Vref2. When the sampled second DC voltage Vout' is less than the threshold voltage Vref2, it represents no overvoltage occurred in the second DC voltage Vout so that the operational amplifier OP1 turns off the transistor Q8. Accordingly, the switch signal ON/OFF determines whether or not the DC voltage Vdc3 supplied power to the PWM controller U2 to control whether or not the PWM controller U2 (or the PWM control circuit 34) works. When the sampled second DC voltage Vout' is greater than the threshold voltage Vref2, it represents an overvoltage occurred in the second DC voltage Vout so that the operational amplifier OP1 turns on the transistor Q8 to cause the switch signal ON/OFF to be pulled low. Accordingly, the switch signal ON/OFF always controls the PWM control circuit 34 to stop working.

Figure 8:
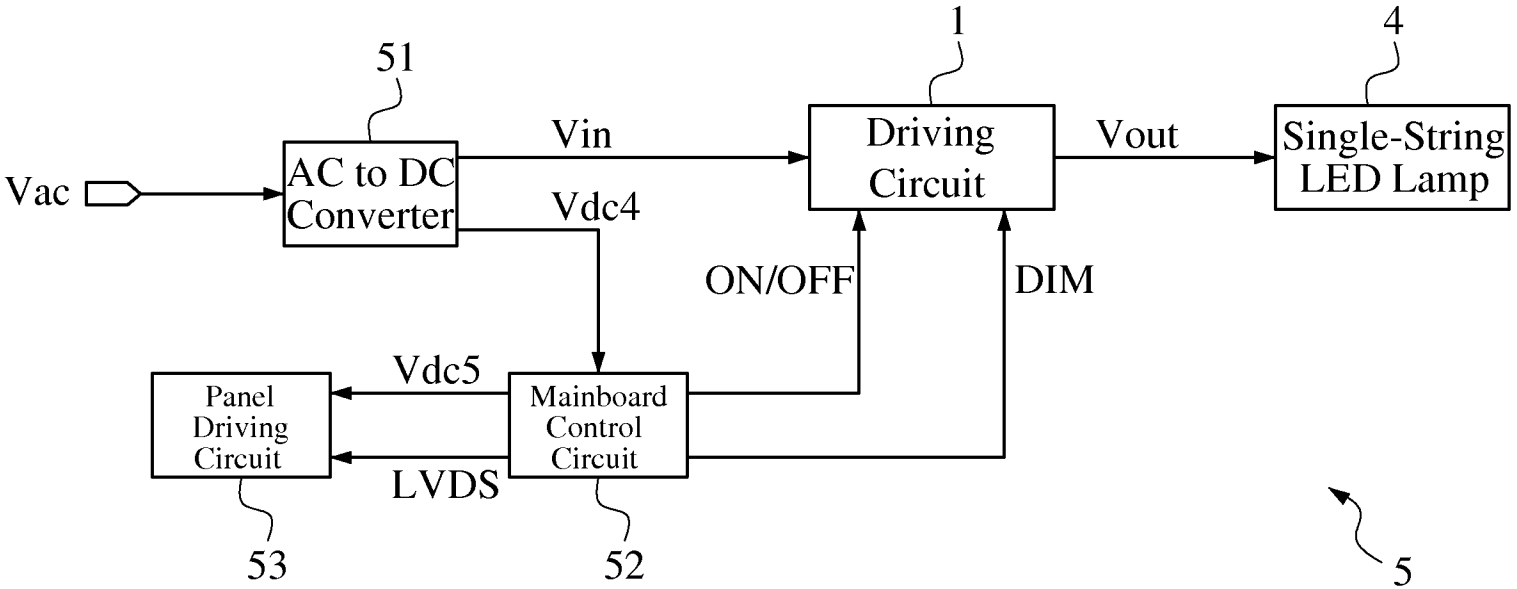
FIG. 8 is a schematic block diagram illustrating an embodiment of an LCD according to the present invention.

FIG. 8 is a schematic block diagram illustrating an embodiment of an LCD according to the present invention. Referring to FIG. 8, an LCD 5 includes an AC to DC converter 51, a mainboard control circuit 52 and a panel driving circuit 53, and further includes the single-string LED lamp 4 and its driving circuit 1 shown in FIG. 1. The single-string LED lamp 4 serves as a backlight of the LCD 5. The LCD 5 is, for example, an LCD monitor, an LCD television and an all-in-one computer. The AC to DC converter 51 converts an input AC voltage Vac to the DC voltages Vin and Vdc4 to supply power to the driving circuit 1 and the mainboard control circuit 52, respectively. The mainboard control circuit 52 includes a built-in DC to DC converter for converting the DC voltage Vdc4 to a DC voltage Vdc5 to supply power to the panel driving circuit 53. The mainboard control circuit 52 outputs the switch signal ON/OFF and the dimming signal DIM to control the driving circuit 1 to drive the single-string LED lamp 4, and further outputs a control signal LVDS to control the panel driving circuit 53 to drive a panel to display image data.

In summary, the driving circuit for the single-string LED lamp uses the push-pull converter to convert the input low first DC voltage (such as 12V-19V) to the high second DC voltage (such as above 200V) to supply power to the single-string LED lamp, to control the lamp current flowing through the single-string LED lamp by constant current and to adjust the brightness of the single-string LED lamp by PWM dimming. In addition, the single-string LED lamp provides the standardization design for connectors of the driving circuit used to connect to the single-string LED lamp so that the driving circuit has better common-use characteristic. Moreover, the driving circuit does not need a current balance circuit and only needs a cheaper and general-purpose IC to control the push-pull converter to reduce the design cost of the driving circuit.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A driving circuit for a single-string light-emitting diode (LED) lamp having an input terminal and an output terminal, comprising:

a dimming control circuit for receiving a dimming signal of a pulse-width modulation (PWM) waveform, with the dimming signal comprising a plurality of consecutive cycles, with each cycle comprising an on period and an off period;

a current feedback circuit and the dimming control circuit coupled in series between the output terminal and a ground terminal, wherein during the on period, the dimming control circuit controls the output terminal and the ground terminal to be closed and the current feedback circuit detects a lamp current flowing through the single-string LED lamp and outputs a first feedback voltage to a feedback terminal according to the lamp current; wherein during the off period, the dimming control circuit controls the output terminal and the ground terminal to be open and outputs a second feedback voltage to the feedback terminal and the current feedback circuit does not detect the lamp current to stop outputting the first feedback voltage;

a PWM control circuit coupled to the feedback terminal and the PWM control circuit for outputting two PWM signals which are 180 degrees out of phase with each other when receiving the first feedback voltage, and for stopping outputting the two PWM signals when receiving the second feedback voltage; and a push-pull converter coupled to the input terminal and the PWM control circuit, the push-pull converter converts, according to the PWM signals, a first direct-current (DC) voltage to a second DC voltage output to the input terminal when receiving the two PWM signals, and stopping converting and outputting the second DC voltage when not receiving the two PWM signals, wherein the dimming control circuit comprises:

a unidirectional component;

a first inverter for receiving the dimming signal and outputting an antiphase dimming signal which is 180 degrees out of phase with the dimming signal, with the antiphase dimming signal coupled to the feedback terminal through the unidirectional component to stop outputting the second feedback voltage related to the antiphase dimming signal to the feedback terminal during the on period, and output the second feedback voltage to the feedback terminal during the off period;

a second inverter coupled to the first inverter, with the second inverter receiving the antiphase dimming signal and outputting an in-phase dimming signal which is 180 degrees out of phase with the antiphase dimming signal; and a switch and the current feedback circuit coupled in series between the output terminal and the ground terminal, with the switch turned on or off according to the in-phase dimming signal, with the switch turned on to control the output terminal and the ground terminal to be closed during the on period, and with the switch turned off to control the output terminal and the ground terminal to be open during the off period.

2. The driving circuit for a single-string LED lamp according to claim 1, wherein the PWM control circuit comprises:

a PWM controller comprising an error amplifier having a non-inverting input terminal coupled to the feedback terminal, an inverting input terminal coupled to receive a reference voltage and an output terminal, with the reference voltage equal to the first feedback voltage and less than the second feedback voltage, with the error amplifier controlling the PWM controller to output the two PWM signals when the feedback terminal's voltage is equal to the reference voltage, and controlling the PWM controller to stop outputting the PWM signals when the feedback terminal's voltage is greater than the reference voltage; and an RC compensation circuit coupled between the inverting input terminal and the output terminal of the error amplifier to provide a negative feedback path.

3. The driving circuit for a single-string LED lamp according to claim 1, further comprising a switch control circuit coupled to the PWM control circuit, with the switch control circuit receiving a switch signal and controlling, according the switch signal, whether or not the PWM control circuit works.

4. The driving circuit for a single-string LED lamp according to claim 1, further comprising an overvoltage protection circuit coupled to the input terminal and the PWM control circuit, with the overvoltage protection circuit controlling the PWM control circuit to stop outputting the PWM signals when the second DC voltage is greater than a threshold voltage.

5. The driving circuit for a single-string LED lamp according to claim 1, wherein the single-string LED lamp is adapted to a backlight of a liquid crystal display (LCD).

6. The driving circuit for a single-string LED lamp according to claim 5, wherein the LCD comprises an LCD monitor.

7. The driving circuit for a single-string LED lamp according to claim 5, wherein the LCD comprises an LCD television.

8. The driving circuit for a single-string LED lamp according to claim 5, wherein the LCD comprises an all-in-one (AIO) computer.

9. A driving circuit for a single-string light-emitting diode (LED) lamp having an input terminal and an output terminal, comprising:

a dimming control circuit for receiving a dimming signal of a pulse-width modulation (PWM) waveform, with the dimming signal comprising a plurality of consecutive cycles, with each cycle comprising an on period and an off period;

a current feedback circuit and the dimming control circuit coupled in series between the output terminal and a ground terminal, wherein during the on period, the dimming control circuit controls the output terminal and the ground terminal to be closed and the current feedback circuit detects a lamp current flowing through the single-string LED lamp and outputs a first feedback voltage to a feedback terminal according to the lamp current; wherein during the off period, the dimming control circuit controls the output terminal and the ground terminal to be open and outputs a second feedback voltage to the feedback terminal and the current feedback circuit does not detect the lamp current to stop outputting the first feedback voltage;

a PWM control circuit coupled to the feedback terminal and the PWM control circuit for outputting two PWM signals which are 180 degrees out of phase with each other when receiving the first feedback voltage, and for stopping outputting the two PWM signals when receiving the second feedback voltage; and a push-pull converter coupled to the input terminal and the PWM control circuit, the push-pull converter converts, according to the PWM signals, a first direct-current (DC) voltage to a second DC voltage output to the input terminal when receiving the two PWM signals, and stopping converting and outputting the second DC voltage when not receiving the two PWM signals, wherein the current feedback circuit comprises:

a unidirectional component; and a current detector and the dimming control circuit coupled in series between the output terminal and the ground terminal, with the current detector detecting the lamp current and outputting, according to the lamp current, a detecting voltage, with the detecting voltage coupled to the feedback terminal through the unidirectional component to output the first feedback voltage related to the detecting voltage to the feedback terminal during the on period, and stop outputting the first feedback voltage to the feedback terminal during the off period.

* * * * *